United States Patent [19]

Gassner et al.

[11] 4,008,563

[45] Feb. 22, 1977

[54] FALSE TWISTING DEVICE

[75] Inventors: Hans Gassner, Schweinfurt; Manfred Kress, Grafenrheinfeld, both of Germany

[73] Assignee: Kugelfischer Georg Schafer & Co., Schweinfurt, Germany

[22] Filed: June 17, 1975

[21] Appl. No.: 587,596

[30] Foreign Application Priority Data

June 20, 1974 Germany ..... 2429493

[52] U.S. Cl. ..... 57/77.45; 57/103; 74/206; 74/210; 57/58.89

[51] Int. Cl.[2] ..... D02G 1/06; D01H 1/12; D01H 1/20

[58] Field of Search ..... 57/77.3, 77.45, 102, 57/103, 92, 58.89; 74/206, 210, 214

[56] References Cited

UNITED STATES PATENTS

| | | | |
|---|---|---|---|
| 3,058,289 | 10/1962 | Raschle | 57/77.3 |
| 3,142,953 | 8/1964 | Gassner et al. | 57/77.45 |
| 3,232,037 | 2/1966 | Crouzet | 57/77.45 |
| 3,267,657 | 8/1966 | Kunzle et al. | 57/77.45 |
| 3,304,706 | 2/1967 | Mattingly | 57/77.45 |
| 3,518,824 | 7/1970 | Raschle | 57/77.45 |
| 3,578,751 | 5/1971 | Kodaira et al. | 57/77.45 |
| 3,763,642 | 10/1973 | Raschle | 57/77.45 |
| 3,831,366 | 8/1974 | Raschle | 57/77.45 |

*Primary Examiner*—John Petrakes
*Attorney, Agent, or Firm*—Stevens, Davis, Miller & Mosher

[57] ABSTRACT

An open end spinning device or a false twisting device having two mutually parallel pairs of rollers for driving a spinning rotor or a twisting tube and a horseshoe-shaped magnet associated therewith for retaining the twisting tube or rotor in a wedge-shaped nip between the pairs of roller, each pole of the magnet acting on a collar on the rotor or twisting tube and being provided with a recess extending parallel to the axis of rotation of the rotor or tube and having a semi-circular cross-section to receive the collar is provided with a magnet having one pole shaped so that upon axially displacement of the rotor or tube away from its normal position by pull of the thread each of the collars still lies opposite the magnet at least at the base thereof.

4 Claims, 6 Drawing Figures

FALSE TWISTING DEVICE

The invention relates generally to spinning and false twisting devices, primarily to false twisting devices of the kind with two mutually parallel pairs of rollers for driving a spinning rotor twisting tube and with a horseshoe-shaped magnet for retaining the rotor tube in a wedge-shaped nip between the pairs of rollers, each pole of the magnet acting on a respective collar on the rotor or twisting tube and being provided with a recess extending parallel to the axis of rotation of the rotor or tube and having a semi-circular cross-section to receive the collar. Such false twisting devices are disclosed in British Patent Specification 938,457, the disclosure of which is incorporated herein by reference.

In these, the magnet forms a magnetic field along the axis of rotation of the twisting tube in order to hold the twisting tube against the pairs of friction rollers, at least one of which pairs is driven, for example by a tangential belt. The approximately semi-cylindrical recess in each pole for receiving the adjacent collar on the twisting tube has a radius which is smaller than the radius of the collar. In this way the magnetic flux is concentrated at the two longitudinal edges of the mouth of each recess, so that the twisting tube is directly pulled into the wedge-shaped nip between the pairs of rollers. In addition to this radial retention of the twisting tube, it has been proposed that, for axial retention, the collars on the twisting tube should be provided with conical faces and should cooperate with the two adjacent rollers, lying in the same plane, of the two pairs. Between each collar and the two adjacent rollers there is only a very small amount of play so that even with the maximum possible axial displacement of the twisting tube as a consequence of the pull in the thread passing through it, both collars remain within the range of the pulling force of the magnetic field extending from the pole shoes.

In false twisters with the twisting tube held magnetically against the driving and supporting rollers there is a problem that, on the one hand, the magnet should exert the greatest possible retaining force on the twisting tube but, on the other hand, the heat generated in the twisting tube as a result of eddy currents must not be excessive, even at extremely high speeds of rotation, for example, above 600,000 or even 800,000 r.p.m. Added to this is the fact that the twisting tube must be held not only radially but also axially and that, at least in the known designs, an increase in the radial retaining force by altering the shape of the recesses in the poles of the magnet results in a corresponding reduction in the axial retaining force. Also, one must take into account that, if one is to maintain the radial holding force in the presence of axial displacement of the twisting tube by the pull of the thread, the collars on the twisting tube must be relatively broad, which leads to a stray magnetic field, causing increased induction and a correspondingly higher temperature of the twisting tube.

As explained, attempts have been made to overcome these difficulties in the above-mentioned known false twisters by allowing the collars on the twisting tube to cooperate mechanically with the associated pairs of rollers in an axial direction. Also it is known to design the twisting tube specially to take account of this problem, namely with a central cylindrical armature of alloy steel having on it the two collars that cooperate with the poles of the magnet and also carrying a transversely extending twisting pin, and with two hollow cylindrical running pins of tool steel pressed into opposite ends of a longitudinal bore in the armature, so that the twisting tube, made of steel, experiences a smaller heating effect from the resulting eddy currents, and the temperature does not reach an unacceptable level, even at the necessary high rotational speeds.

The chief object of the invention is to provide a false twisting device of the kind described in the opening paragraph above, in which the twisting tube is reliably held magnetically both in a radical and an axial direction even at extremely high speeds and high tensile force in the thread, without resulting in unacceptable heating of the twisting tube.

Other objects will become apparent from the following description with reference to the accompanying drawing wherein FIG. 1 is a diagrammatic front elevation of one embodiment of the invention;

Figure 1:
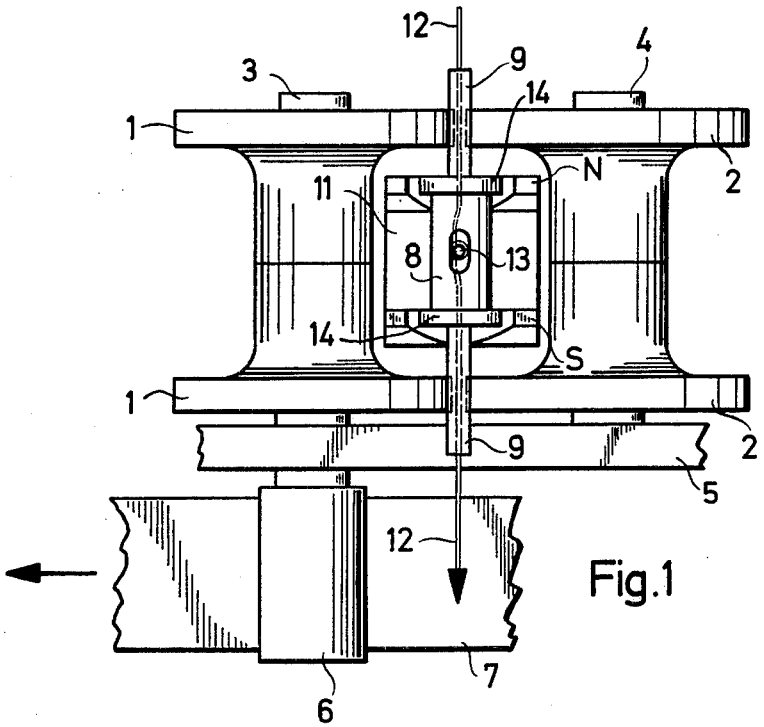

The foregoing objects and others are accomplished in accordance with this invention, generally speaking, by providing an open end spinning or false twisting device having two mutually parallel pairs of rollers for driving a spinning rotor or twisting tube and a horseshoe-shaped magnet associated therewith for retaining the twisting tube in a wedge-shaped nip between the pairs of rollers, each pole of the magnet acting on a respective collar on the twisting tube and being provided with a recess extending parallel to the axis of rotation of the tube and having a semi-circular cross-section to receive the collars, each of the collars being embraced substantially over half its periphery by the associated pole of the magnet, and at least one pole of the magnet being shaped whereby on axial displacement of the tube away from its normal position by the pull of a thread passing axially through the tube each collar still lies at least opposite the base of the associated recess.

In the device provided by the invention there are only small eddy currents in the twisting tube, even at extremely high rotational speeds. Not only does this keep down the heat generated in the twisting tube but also the power needed for driving the tube is correspondingly reduced. The collars on the twisting tube can be kept relatively small as, when the tube is displaced away from its normal position by the pull in the thread, this displacement being opposed by the magnetic axial restoring force that builds up, the radial magnetic force also is maintained, even with small collars on the twisting tube. The small collars lead, in conjunction with the pointed magnetic poles, to the magnetic flux being concentrated where it enters the twisting tube so that stray fields are kept to a minimum and accordingly there is minimum induction.

Although primarily of use in false twisters, the invention can also be applied to open-end spinning rotors.

It has been proposed before to provide a false twisting device of the general kind with which we are concerned with a twisting tube which has a ferromagnetic portion substantially spherical in shape and a magnet arranged between the pairs of rollers and acting on the ferromagnetic portion of the tube. The magnet should have at least one magnetic pole directed towards the center of the ferromagnetic portion to prevent longitudinal oscillations of the twisting tube before it starts. The magnetic field, which is always perpendicular in the surface of the ferromagnetic portion of the twisting tube and accordingly exerts its force in this direction, is intended to act so that on displacement of the twisting tube there is immediately built up a force component in the opposing direction, to pull the twisting tube back again and thereby damp out any incipient longitudinal oscillations straight away. The ball-shaped portion of the twisting tube is moreover intended to behave like a stable spinning top in order to improve the running characteristics of the twisting tube (German Auslegeschrift No. 1 962 304).

The false twisting device shown in FIG. 1 comprises two pairs of friction rollers 1 and 2, each pair being mounted on a common spindle 3 and 4, respectively. The two spindles 3 and 4 are arranged parallel to each other and are mounted to rotate on a common carrier 5. One spindle 3 passes through the carrier 5 and is provided on its lower end, with a wharf 6, engaged by a tangentially moving belt 7.

The two pairs of rollers 1 and 2 serve to drive a false twisting tube 8 which has two hollow cylindrical running pins 9 which engage the rims of the four rollers 1 and 2, and these rollers, or at least their rims, may be made, for example, of polyurethane of suitable hardness. The drive is effected by the belt 7 which, through the wharf 6, rotates the pair of rollers 1 and this rotates the twisting tube 8. This in its turn causes the second pair of rollers 2 to rotate, these rollers thus simply serving as a support for the tube 8.

Figure 2:
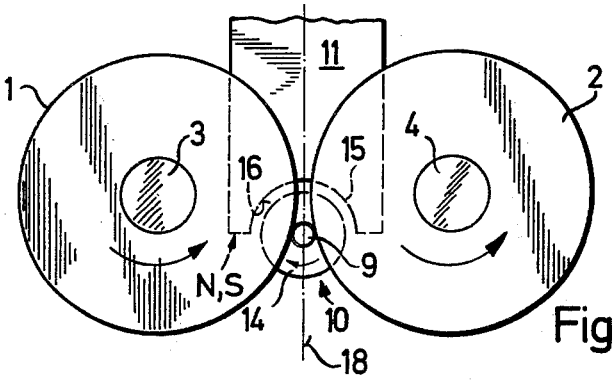
FIG. 2 is a diagrammatic plan view of the embodiment of FIG. 1.

To retain the twisting tube 8 in the wedge-shaped nip 10 between the pairs of rollers there is a stationary permanent magnet 11. The direction of the drive is such that the driving pair of rollers 1 are moving towards the magnet 11 at their points of engagement with the twisting tube 8. The direction of rotation of the rollers and of the twisting tube 8 is indicated in FIG. 2 by arrows, and so is the direction of travel of the belt 7 in FIG. 1. The pairs of rollers 1 and 2 can rotate, for example, at a speed of 40,000 r.p.m. so that the twisting tube rotates at a speed of, for example, 800,000 r.p.m.

The twisting tube 8 serves to false-twist a synthetic thread 12 which passes axially through the twisting tube 8, running from top to bottom in the case illustrated. On its way, the thread passes once around a central transversely mounted twist pin 13 in the middle of the tube 8.

The central cylindrical portion of the twisting tube 8, which forms an armature for the permanent magnet 11, has two small collars 14 with which the magnet 11 cooperates, namely with its north pole N and its south pole S.

Each pole N and S is provided with a recess 15 extending parallel to the axis of the twisting tube and having a semi-circular cross-section, to receive the associated collar 14, the radius of the recess being such that, in the normal position of the twisting tube 8 shown in FIG. 1, each collar 14 is embraced over about half its periphery by the associated pole N or S. Each pole N and S is shaped so that on axial displacement of the twisting tube 8 away from its normal position by the pull of the thread 12 the collars 14 each lie still opposite at least the base 16 of the associated recess 15, as made clear in FIG. 3.

For this purpose each pole N and S is bevelled on that face towards which the twisting tube 8 experiences a displacement. The plane 17 of the bevel on each pole N and S extends perpendicular to the common central plane 18 of the two recesses 15 and makes, with a plane perpendicular to the common longitudinal axis 19 of the two recesses 15, i.e., with a plane which is perpendicular to the plane of the drawing of FIG. 3, an angle alpha of at least 20°.

The inner face of each recess 15 is therefore made up of a semi-cylindrical portion about the width of the associated collar 14 and a tapered portion forming the surface of a corresponding cylindrical horseshoe, of which the maximum height may correspond, for example, likewise to the width of the associated collar 14 on the twisting tube, as illustrated.

Figure 3:
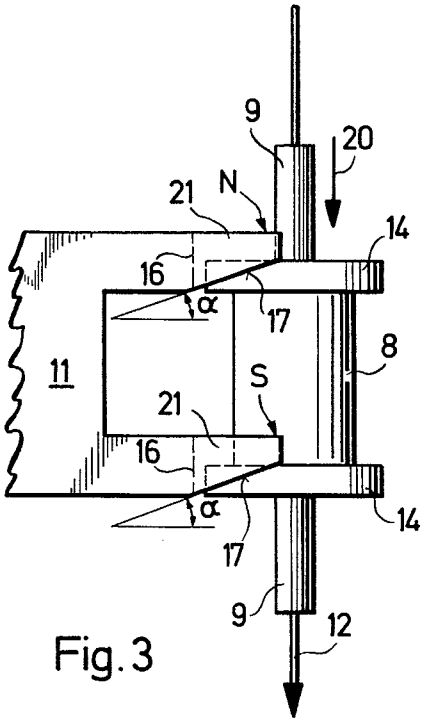
FIG. 3 is a view looking from the left in FIG. 1 of the pole end of the permanent magnet in the embodiment of FIGS. 1 and 2, the associated twisting tube being shown in its position of maximum axial displacement.

When, during running, the twisting tube 8 is displaced by the pull of the thread 12, away from its normal position shown in FIG. 1, in the direction of the arrow 20 to the position shown in FIG. 3, the collars 14 then no longer lie between the two lateral tips 21 of the associated magnet pole N or S but they still do lie in front of at least the bases 16 of the associated recesses 15. In this way, not only is a strong axial restoring force exerted by the magnet 11 on the twisting tube 8, opposite to the direction of the arrow 20, but also the radial retaining force is maintained, i.e., that force by which the magnet 11 attracts the twisting tube 8 into the wedge-shaped nip 10 between the pairs of rollers 1 and 2.

Figure 5:
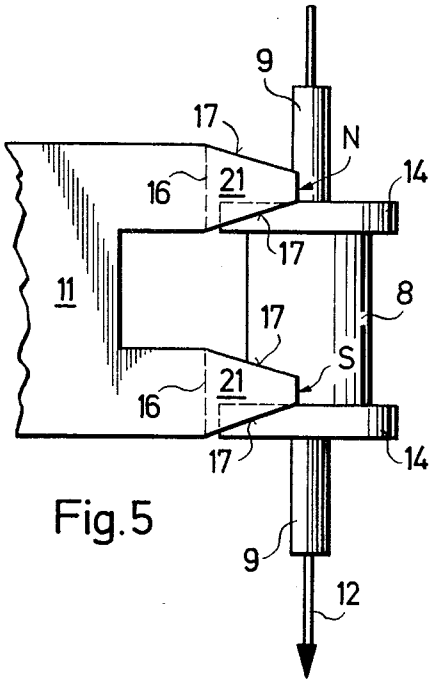
FIG. 5 is a view corresponding to FIG. 3 but showing a second embodiment.
Figure 4:
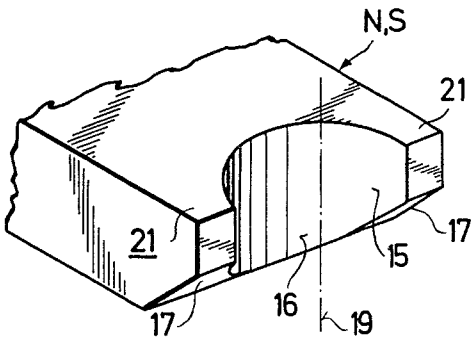
FIG. 4 is a perspective view of one pole of the permanent magnet in the embodiment of FIGS. 1 to 3.

The embodiment shown in FIG. 5 differs from that of FIGS. 1 to 4 only in that each pole N and S of the magnet 11 is provided with bevelled planes 17 on both sides. This embodiment is therefore suitable for use where the thread 12 may be required to run through the device both in a downward direction and in an upward direction as viewed in the drawing. In the condition illustrated in FIG. 5 it is assumed that the thread 12 is running downwards through the device and that the twisting tube 8 is being displaced to its maximum extent by the pull of the thread 12.

Figure 6:
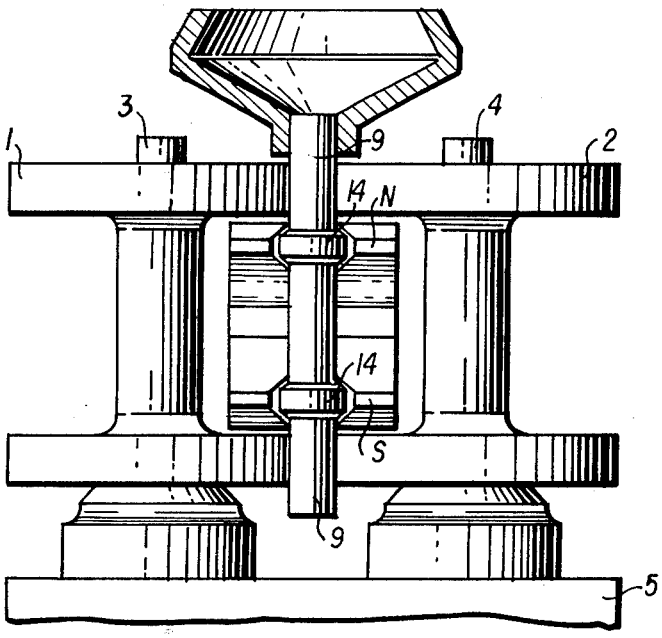
FIG. 6 is a diagrammatic front elevation of one embodiment of an open ended rotor of the invention.

The open end rotor illustrated in FIG. 6 has friction rollers 1 and 2 mounted on spindles 3 and 4, respectively. Spindles 3 and 4 are mounted to rotate on a common carrier 5. The rollers 1 and 2 drive tubular member 9 having collars 14. Collars 14 are disposed in recesses in pole members N and S.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. In an open end spinning or false twisting device having two parallel pairs of rollers for driving a spinning rotor or twisting tube disposed in the nip therebetween and a horseshoe-shaped magnet for retaining the twisting tube or rotor in the nip, said twisting tube or rotor having a pair of longitudinally spaced collars, the improvement wherein said magnet has north and south longitudinally spaced poles having a curved surface each disposed substantially concentrically about one of said collars over more than one-half of the periphery of the collar, at least one pole of the magnet having at least its surface facing in the direction in which the twisting tube or rotor tends to be displaced from its position by the pull of a thread passing axially therethrough beveled whereby upon axial displacement of the tube or rotor each collar still lies opposite the magnet at least at the base of its said curved surface.

2. A false twisting device adapted for crimping synthetic threads comprising two pairs of friction discs disposed substantially parallel to each other and enclosing a wedge-shaped nip therebetween, a false twisting tube disposed in the nip and drivably associated with the friction discs, said false twisting tube having a pair of longitudinally spaced collars, a magnet having two poles each of which has a recess substantially concentric with the periphery of one of said collars, said magnet being disposed in the nip with one of its poles embracing the periphery of each of the collars, said magnet having a recess which extends between the poles of greater depth than the recesses in the poles whereby each collar faces only a pole of the magnet, each of said poles having a beveled surface on that side thereof towards which the false twisting tube tends to be displaced, said beveled surface extending in a plane which is perpendicular to the common central plane of the recesses in the poles, the included angle between the beveled surface and a plane perpendicular to the common axis of the recesses in the poles being at least 20°.

3. The device of claim 1 in which the plane of bevelling of each pole makes, with a plane perpendicular to the common longitudinal axis of the two recesses, an included angle of at least 20°.

4. The device of claim 1 wherein each pole is correspondingly shaped or bevelled on both sides.

* * * * *